United States Patent [19]

Boeder

[11] Patent Number: 4,699,334

[45] Date of Patent: Oct. 13, 1987

[54] DEPLOYABLE WING FOR MISSILE OR PROJECTILE

[75] Inventor: Dieter Boeder, Düsseldorf, Fed. Rep. of Germany

[73] Assignee: Rheinmetall GmbH, Düsseldorf, Fed. Rep. of Germany

[21] Appl. No.: 907,731

[22] PCT Filed: Sep. 6, 1985

[86] PCT No.: PCT/EP85/00452

§ 371 Date: Jul. 23, 1986

§ 102(e) Date: Jul. 23, 1986

[87] PCT Pub. No.: WO86/02154

PCT Pub. Date: Apr. 10, 1986

[30] Foreign Application Priority Data

Sep. 25, 1984 [DE] Fed. Rep. of Germany ..... 3435063

[51] Int. Cl.[4] ..... F42B 13/32

[52] U.S. Cl. ..... 244/3.23; 244/3.29

[58] Field of Search ..... 244/3.23, 3.26–3.3

[56] References Cited

U.S. PATENT DOCUMENTS 2,923,241 2/1960 House ..... 244/3.29
3,103,886 9/1963 Popenoe ..... 244/3.29

FOREIGN PATENT DOCUMENTS 30264 3/1982 Fed. Rep. of Germany .
23823 of 1896 United Kingdom ..... 244/3.29
745252 2/1956 United Kingdom ..... 244/3.29

*Primary Examiner*—Deborah L. Kyle
*Assistant Examiner*—Michael J. Carone

[57] ABSTRACT

A wing for an aircraft extending along and normally intended to move along a main axis comprises a first pivot fixed on the aircraft and defining a fixed pivot axis generally parallel to the main axis, a guide extending angularly on the aircraft adjacent the first pivot, and a second pivot defining a movable axis generally parallel to the main axis and displaceable in the guide between an inner end position closely juxtaposed with the fixed axis and an outer end position spaced angularly therefrom. A first wing plate is pivotal about the fixed axis and has an inner end fixed to the fixed pivot and an outer end and a second wing plate is pivotal about the movable axis and has an outer end fixed to the outer end of the first plate and an inner end fixed to the second pivot. The wings are displaceable between an undeployed position lying against one another and against the aircraft with the movable axis in the inner end position close to the fixed axis and a deployed position with both wings extending at an angle to each other and generally radially of the aircraft and with the movable axis in the outer end position far from the fixed axis.

11 Claims, 5 Drawing Figures

DEPLOYABLE WING FOR MISSILE OR PROJECTILE

FIELD OF THE INVENTION

The present invention relates to a wing for an aircraft. More particularly this invention concerns a tail unit for a missile or projectile.

BACKGROUND OF THE INVENTION

A deployable tail unit as described in German Pat. No. 3,026,409 has wings each constituted as a textile two-wall cover and a partially telescoping strut arrangement that erects it. The strut arrangement is formed of a plurality of parts which take up a relatively large space within the missile and therefore constitute a considerable portion of lost space, and the construction of these parts is fairly expensive. In addition the deployment of the wing is problematic in view of the high acceleration forces created when the aircraft in question is fired or launched.

A fold-down wing is known which is a simple flap that folds against the side of the aircraft and that is erected by a spring when the projectile is launched, typically when it exits the barrel of the cannon from which it is fired. The wings are, however, invariably relatively flimsy and this lack of rigidity reduces their aerodynamic effectiveness.

Another disadvantage of the known wings is that they are unable to impart spin to the vehicles because they are not rigid enough to withstand the angular forces created in such a situation.

OBJECTS OF THE INVENTION

It is therefore an object of the present invention to provide an improved wing for an aircraft such as a projectile or missile.

Another object is the provision of such a wing for an aircraft such as a projectile or missile which overcomes the above-given disadvantages, that is which takes up very little space when not deployed, which is relatively simple and inexpensive, and which is nonetheless fairly rigid when erect, because the wing plates are curved like buckles about two axes when deployed.

SUMMARY OF THE INVENTION

A wing for an aircraft extending along and normally intended to move along a main axis comprises a first pivot fixed on the aircraft and defining a fixed pivot axis generally parallel to the main axis, a guide extending angularly on the aircraft adjacent the first pivot, and a second pivot defining a movable axis generally parallel to the main axis and displaceable in the guide between an inner end position closely juxtaposed with the fixed axis and an outer end position spaced angularly therefrom. A first wing plate is pivotal about the fixed axis and has an inner end fixed to the fixed pivot and an outer end and a second wing plate is pivotal about the movable axis and has an outer end fixed to the outer end of the first plate and an inner end fixed to the second pivot. The wings are displaceable between an undeployed position lying against one another and against the aircraft with the movable axis in the inner end position close to the fixed axis and a deployed position with both wings extending at an angle to each other and generally radially of the aircraft and with the movable axis in the outer end position far from the fixed axis.

According to this invention both wing plates are flexible and elastic and this elasticity is what moves them into the deployed position. More particularly the wing plates are more elastically deformed in the undeployed than in the deployed position so that when unconstrained they naturally move into the deployed position.

According to another feature of this invention each pivot includes at least one pivot pin extending along the respective pivot axis and secured to the respective inner plate end. The pivot pin of the second plate is displaceable along the guide. In addition at least one of the pins is comprised of two pin parts arranged coaxially of the respective axis. This two-part pin is the pin of the second plate and is engaged in the guide and the guide is two grooves into which the respective pin parts are engaged and has ends remote from the fixed pivot formed with inwardly open recesses. In this case the wing has springs engaged with the pin parts for urging same outwardly and for pressing same lockingly into the recesses when the respective pin parts are aligned therewith. Thus the pin parts lock the movable pivot relative to the aircraft when engaged in the respective recesses.

In accordance with another inventive feature the recesses are aligned on a recess axis extending at an acute angle to the fixed pivot axis. Thus when the pin parts are engaged in the recesses the wing plates are twisted to impart spin to the aircraft in flight.

The wing plates of this invention are curved when undeformed. This curvature is about one or two axes. Curvature about a longitudinal axis of each wing plate can be achieved by fitting the wings to appropriately curved hinge plates. In any case according to this invention the wing plates are concavely arcuate away from each other when in the deployed position and are concavely arcuate toward the main axis when in the undeployed position.

DESCRIPTION OF THE DRAWING

The above and other features and advantages will become more readily apparent from the following, reference being made to the accompanying drawing in which.

SPECIFIC DESCRIPTION

Figure 2:
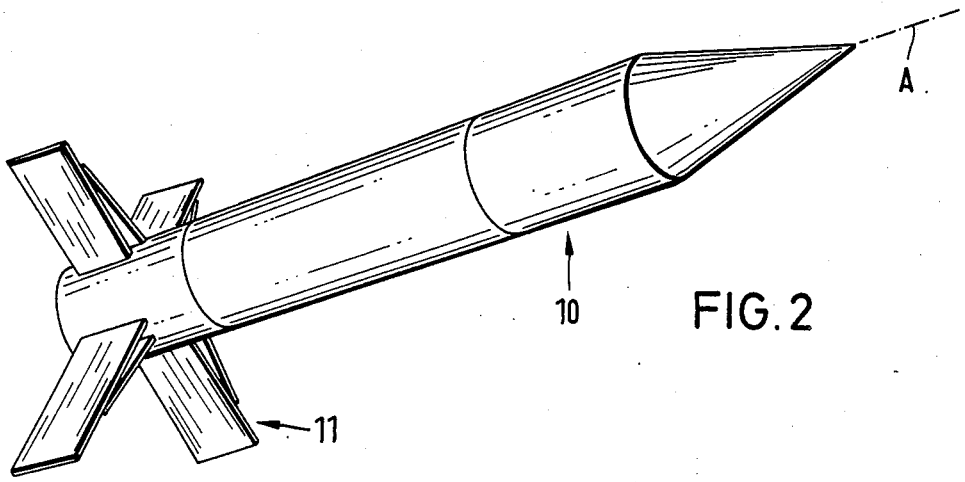
FIG. 2 is a small-scale perspective view of the missile with its wings deployed.

As seen in FIG. 2 a rocket 10 is generally cylindrical and extends along an axis A which is the center of its normal flight trajectory. This rocket 10 is provided with four identical wings 11 which extend radially from its tail.

Figure 1:
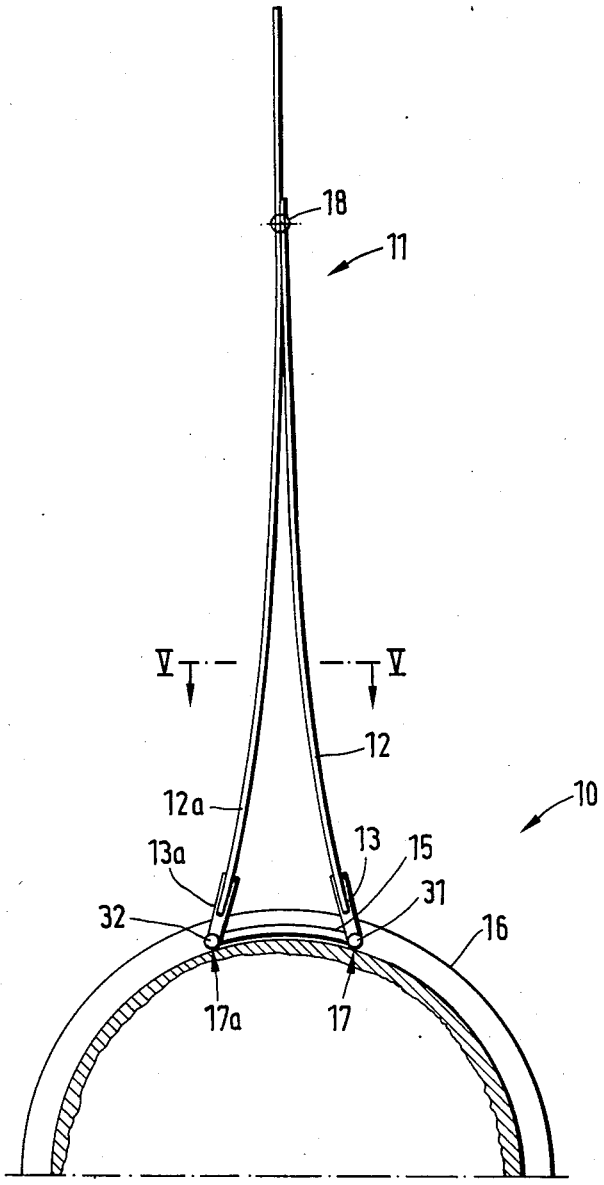
FIG. 1 is a partial cross section through a missile provided with a wing according to this invention, the wing being in the erect deployed position.
Figure 3:
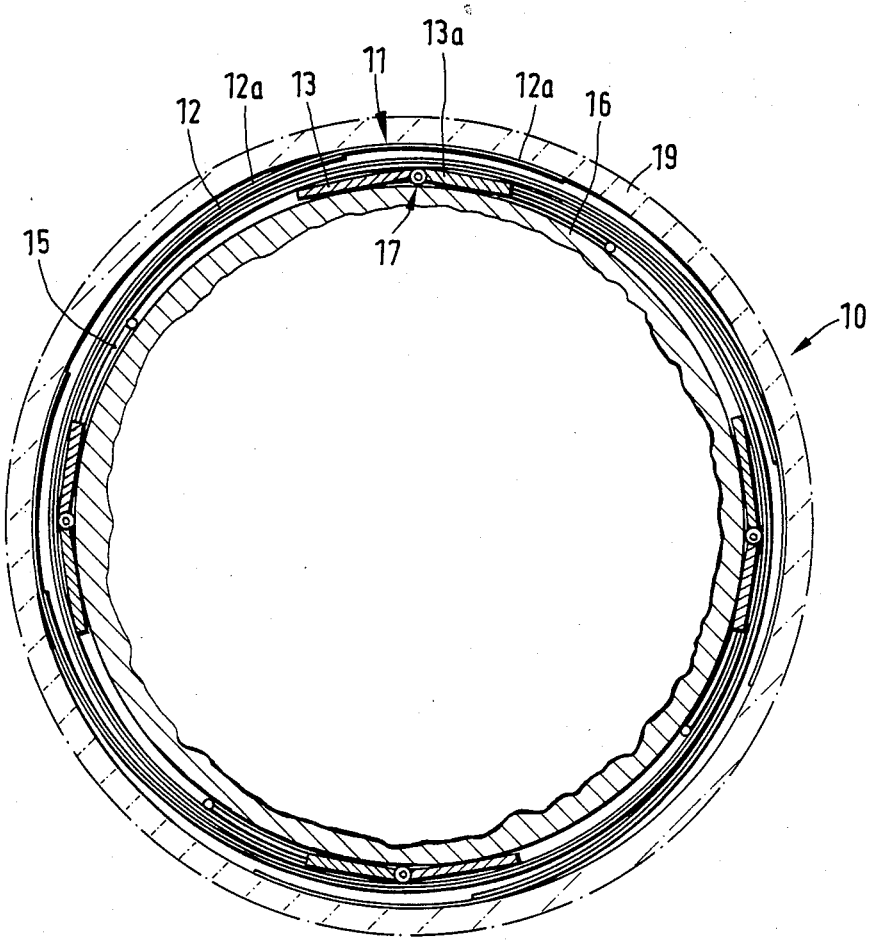
FIG. 3 is a cross section through the missile or projectile while in a casing or barrel with the wings not deployed.

FIGS. 1 and 3 show how each wing 11 is formed of a pair of flexible plates 12 and 12*a* formed of a highly flexible and elastic material such as spring steel, a light-metal alloy, or a fiber-reinforced plastic. The plates 12 and 12*a* have outer ends secured together by a rivet 18 and inner ends secured in respective mounts 13 and 13*a* pivotal about respective pivots or hinges 17 and 17*a*. Between their inner ends and the rivet 18 the plates 12 and 12*a* are identical.

The missile 10 has a casing 16 in which each of the pivots 13 is pivotal about a respective stationary axis pin 31 extending parallel to the axis A. In addition this casing 15 is formed at each wing 11 with two guide grooves 15 extending angularly from an inner end axially aligned with the respective pin 31 and an outer end spaced angularly therefrom by a distance here equal to about one-twelfth the circumference of the casing 16.

Figure 4:
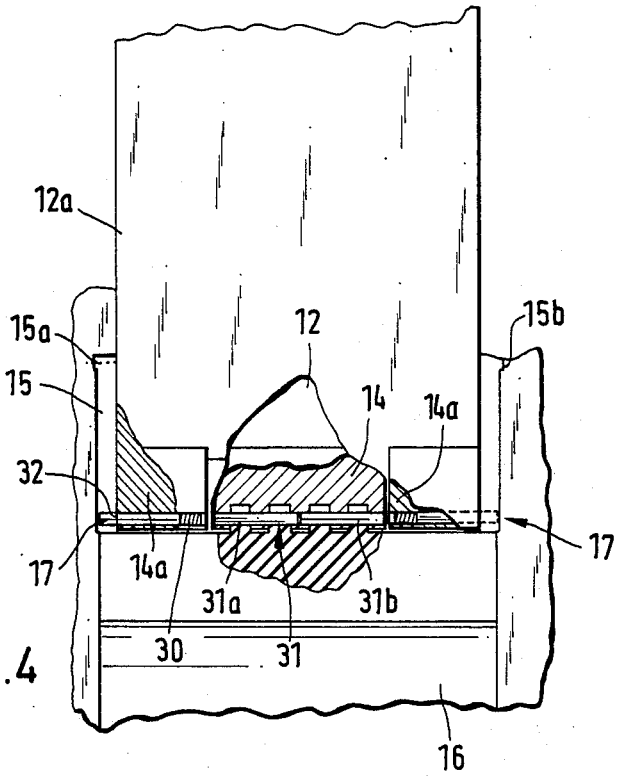
FIG. 4 is a partly sectional side view of the wing assembly with the wing undeployed.
Figure 5:
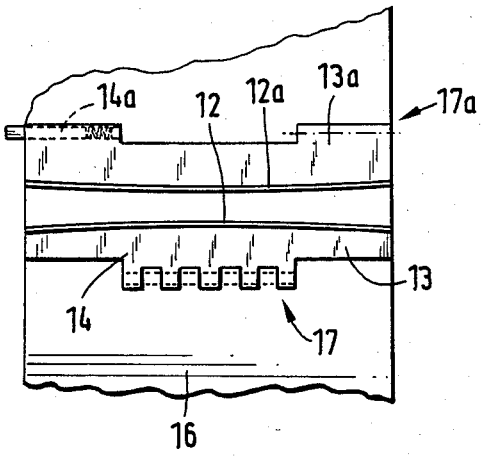
FIG. 5 is a section taken along line V—V of FIG. 1.

As best seen in FIGS. 4 and 5 the mount 13 has a central tab 14 and the pin 31 has two parts 31*a* and 31*b*. This tab 14 is crenellated or toothed and interfits with teeth of the housing 16 so as to form the stationary hinge 17. The mount 13*a* is formed with two such tabs 14*a* that receive respective stop pins 31 that are coaxial but urged axially apart into the grooves 15 by springs 30. The ends of these grooves 15 remote from the stationary pivot pin 31 are formed with coaxial and inwardly open recesses 15*a* into which the ends of the pins 32 can fit, although as illustrated in FIG. 4 in dashed lines it is possible for a recess 15*b* to be provided in the one groove 15 that is not axially aligned with the other recess 15*a*.

FIG. 3 illustrates how the wings 11 can be wound around the casing 16, as for instance when the missile 10 is retained in a barrel 19, and can in fact be recessed within a groove formed in the casing 16. In this position each wing's plates 12 and 12*a*, which have a length equal to about half of the circumference of the casing 16, therefore overlie at least the base of one of the adjacent wings 11. In addition in this position both plates 12 and 12*a* are deformed into a part-cylindrical shape and the pins 31 and 32 of each wing 11 are coaxial.

When nothing radially constrains the wings 11 they spring out to the FIG. 1 position. As this occurs the pins 32 slide along the grooves 15 until they come to the recesses 15*a* or 15*b*, whereupon they are pressed therein by the springs 30. This action causes the plates 12 and 12*a* to pivot out and project generally radially from the casing 16 as illustrated in FIG. 1, forming a roof shape.

To facilitate this deployment the plates 12 are of part-cylindrical shape, imparted to them by rolling or by cutting them from a cylindrical sleeve. As also shown in FIG. 5 the plates 12 and 12*a* of each wing 11 are curved somewhat convexly toward each other, an effect achieved by appropriately shaping the mounts 13 and 13*a* and/or the slots into which the inner plate ends fit.

I claim:

1. A wing for an aircraft extending along and normally intended to move along a main axis, the wing comprising:

a first pivot fixed on the aircraft and defining a fixed pivot axis generally parallel to the main axis;

a guide extending angularly on the aircraft adjacent the first pivot;

a second pivot defining a movable axis generally parallel to the main axis and displaceable in the guide between an inner end position closely juxtaposed with the fixed axis and an outer end position spaced angularly therefrom;

a first wing plate pivotal about the fixed axis and having an inner end fixed to the fixed pivot and an outer end;

a second wing plate pivotal about the movable axis and having an outer end fixed to the outer end of the first plate and an inner end fixed to the second pivot; and means for displacing the wing plates between an undeployed position lying against one another and against the aircraft with the movable axis in the inner end position close to the fixed axis and a deployed position with both wings extending at an angle to each other and generally radially of the aircraft and with the movable axis in the outer end position far from the fixed axis.

2. The wing defined in claim 1 wherein each pivot includes at least one pivot pin extending along the respective pivot axis and secured to the respective inner plate end.

3. The wing defined in claim 2 wherein the pivot pin of the second plate is displaceable along the guide.

4. The wing defined in claim 3 wherein at least one of the pins is comprised of two pin parts arranged coaxially of the respective axis.

5. The wing defined in claim 4 wherein the one pin having the two parts is the pin of the second plate and is engaged in the guide, the guide being two grooves into which the respective pin parts are engaged and having ends remote from the fixed pivot formed with inwardly open recesses, the wing further comprising spring means engaged with the pin parts for urging same outwardly and for pressing same lockingly into the recesses when the respective pin parts are aligned therewith, whereby the pin parts lock the movable pivot relative to the aircraft when engaged in the respective recesses.

6. The wing defined in claim 5 wherein the recesses are aligned on a recess axis extending at an acute angle to the fixed pivot axis, whereby when the pin parts are engaged in the recesses the wing plates are twisted to impart spin to the aircraft in flight.

7. A wing for an aircraft extending along and normally intended to move along a main axis, the wing comprising:

a first pivot fixed on the aircraft and defining a fixed pivot axis generally parallel to the main axis;

a guide extending angularly on the aircraft adjacent the first pivot;

a second pivot defining a movable axis generally parallel to the main axis and displaceable in the guide between an inner end position closely juxtaposed with the fixed axis and an outer end position spaced angularly therefrom;

a first flexible and elastic wing plate pivotal about the fixed axis and having an inner end fixed to the fixed pivot and an outer end;

a second flexible and elastic wing plate pivotal about the movable axis and having an outer end fixed to the outer end of the first plate and an inner end fixed to the second pivot, the wing plates being displaceable between an undeployed position lying against one another and against the aircraft with the movable axis in the inner end position close to the fixed axis and a deployed position with both wings extending at an angle to each other and generally radially of the aircraft and with the movable axis in the outer end position far from the fixed axis, the wing plates more elastically deformed in the undeployed than in the deployed position, whereby the plates when unconstrained naturally move into the deployed position.

8. The wing defined in claim 7 wherein the wing plates when undeformed are curved.

9. The wing defined in claim 7 wherein the curvature of the wing plates is about one axis.

10. The wing defined in claim 7 wherein the curvature of the wing plates is about two axes.

11. The wing defined in claim 7 wherein the wing plates are concavely arcuate away from each other when in the deployed position and are concavely arcuate toward the main axis when in the undeployed position.

* * * * *